US005564559A

United States Patent [19]

Chen

[11] Patent Number: 5,564,559

[45] Date of Patent: Oct. 15, 1996

[54] MOUNTING STRUCTURE FOR SWITCHES

[75] Inventor: David C. H. Chen, Taipei, Taiwan

[73] Assignee: Board-Tech Electronic Co., Ltd., Taipei, Taiwan

[21] Appl. No.: 510,596

[22] Filed: Aug. 3, 1995

[51] Int. Cl.[6] ..... H01H 3/00

[52] U.S. Cl. ..... 200/339; 200/553; 200/293

[58] Field of Search ..... 200/293, 553, 200/303, 295, 554, 555, 556, 557, 339, 558, 559, 560, 561, 562, 363

[56] References Cited

U.S. PATENT DOCUMENTS

| | | | |
|---|---|---|---|
| 5,213,204 | 5/1993 | Sommer | 200/303 |
| 5,290,983 | 3/1994 | Roberts | 200/295 |
| 5,412,169 | 5/1995 | Comerci et al. | 200/339 |

*Primary Examiner*—David J. Walczak
*Attorney, Agent, or Firm*—Hawes, Fischer & Dickinson

[57] ABSTRACT

A mounting structure that can be used to put together the constituent parts of a switch unit composed of a turning member, an inserting frame, a mounting base, and a pressing piece easily without the need of extra fastening member as screws or welding. It can also be used to mount the constituent parts of a switch unit securely. The mounting structure comprises first mounting members for mounting the turning member onto the insetting frame; second mounting members for mounting the insetting frame onto the mounting base; and third mounting members for mounting the pressing piece onto the turning member. The first mounting members include two engaging protrusions provided on the turning member and two recessed portions provided on the insetting frame. The second mounting members include a plurality of hook-like members provided on the insetting frame and a corresponding number of engaging holes provided on the mounting base. The third mounting members include at least one pin and two engaging pieces provided on the pressing piece and at least one hole and two protruded edges provided on the turning member.

10 Claims, 3 Drawing Sheets

MOUNTING STRUCTURE FOR SWITCHES

BACKGROUND OF THE INVENTION

1. Field of the Invention

The present invention relates to switch units, and more particularly, to a mounting structure for assembling the constituent parts of a switch unit.

2. Description of Prior Art

A switch unit is usually composed of several parts, including at least a pressing piece for the user to press his/her finger thereon so as to turn on or off the switch and a mounting base for housing wires and electrical contacts therein. Besides, there may be various parts to be provided between the pressing piece and the mounting base acting as mounting means or securing means. On the mounting structure that allows these constituent parts to be assembled into one unit, the use of screws or welding is least desired since that would significantly increase material and labor costs and the assembly work is also inconvenient and time-consuming.

To save material and labor costs, various mounting structures that can mount and secure the switch on the frame without the use of screws or welding have been proposed. These mounting structures can allow the constituent parts of a switch unit to be easily assembled simply by snapping them into position. There is, however, a drawback to these mounting structures that the switch unit thus assembled cannot be reliably assembled. In other words, when subjected to external force, the constituent parts could break loose. There exists therefore a need for a mounting structure that can be used to put the constituent parts of a switch unit together easily such that the assembly is very secure.

SUMMARY OF THE INVENTION

It is therefore a primary objective of the present invention to provide a mounting structure that can be used to put together the constituent parts of a switch unit easily without the need of extra fastening means as screws or welding.

It is another objective of the present invention to provide a mounting structure that can be used to mount the constituent parts of a switch unit securely.

In accordance with the foregoing and other objectives of the present invention, there is provided a novel mounting structure for assembling the constituent parts of a switch unit composed of a turning member, an insetting frame, a mounting base, and a pressing piece. The mounting structure comprises (a) first mounting means for mounting the turning member onto the insetting frame; (b) second mounting means for mounting the insetting frame onto the mounting base; and (c) third mounting means for mounting the pressing piece onto the turning member. The first mounting means includes two engaging protrusions provided on the turning member and two recessed portions provided on the insetting frame. The second mounting means includes a plurality of hook-like members provided on the insetting frame and a corresponding number of engaging holes provided on the mounting base. The third mounting means includes at least one pin and two engaging pieces provided on the pressing piece and at least one hole and two protruded edges provided on the turning member.

On the first mounting means the engaging protrusion has a sloped portion and a curved portion for the engagement. Besides, its head end is arrow-shaped and correspondingly the recessed portion has an arrow-shaped portion to accommodate the arrow-shaped portion of the engaging protrusion. The angle of the arrow-shaped portion of the recessed portion is greater than that of the engaging protrusion. In other embodiment, the engaging protrusions are wedge-shaped. The first mounting means further includes a plurality of semi-sphere or conically-shaped protrusions so as to prevent the turning member from wobbling when the turning member is pressed to turn on/off the switch unit. On the third mounting means each of the engaging pieces has a hook portion and a stopper portion and a gap is formed between the hook portion and the stopper portion so as to hold the protruded edges provided on the turning member.

BRIEF DESCRIPTION OF DRAWINGS

The present invention can be more fully understood by reading the subsequent detailed description of the preferred embodiments thereof with references made to the accompanying drawings, wherein.

DETAILED DESCRIPTION OF PREFERRED EMBODIMENT

Figure 1:
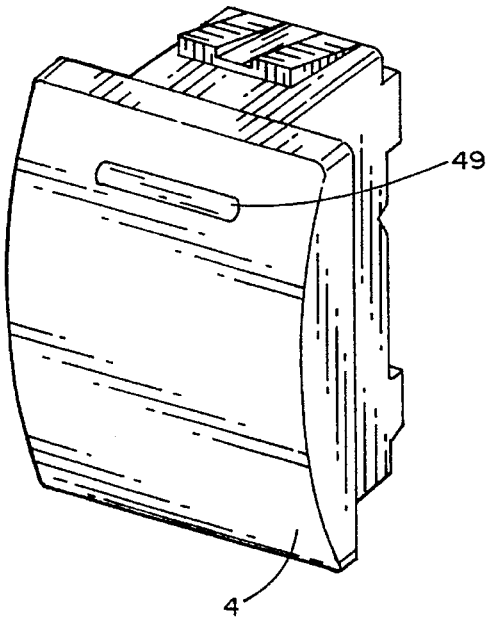
FIG. 1 shows a switch unit.
Figure 2:
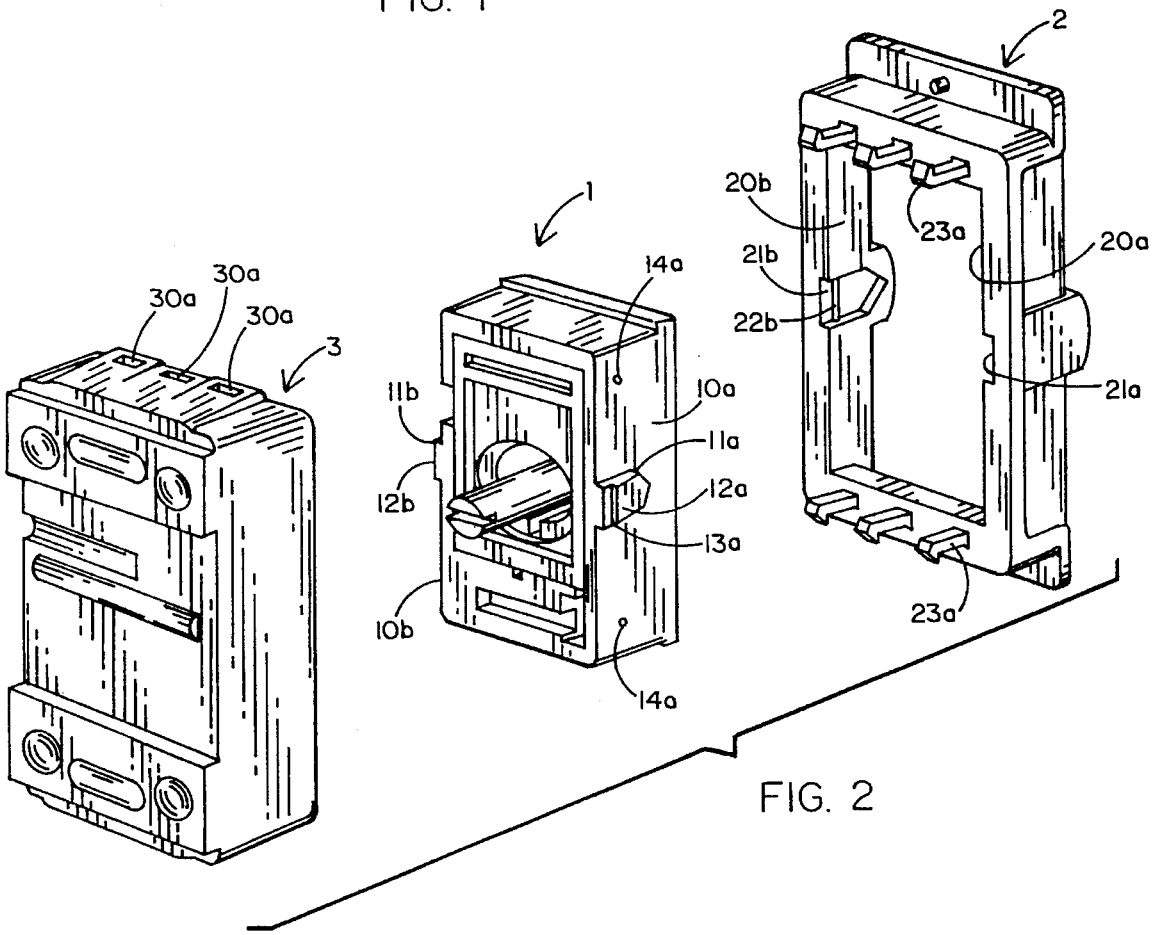
FIG. 2 shows an exploded perspective view of the switch unit of FIG. 1, showing particularly three parts of the switch unit which are to be assembled by means of the mounting structure according to the present invention.

Referring to FIGS. 1 and 2, the purpose of the mounting structure according to the present invention is to assemble the four parts of a switch unit, namely a turning member 1, an inserting frame 2, a mounting base 3, and a pressing piece 4. The inserting frame 2 is used to inset the turning member 1 therein in such a way that the turning member 1 can be turned so as to change the position of electrical contact (not shown) housed in the mounting base 3; and the pressing piece 4 is used for the user's hand to press on it to turn on or off the switch unit. The pressing piece 4 has a conventional provision of a transparent window 49 that allows the user to see an on/off indicating lamp (not shown) provided therebehind. The assembly of the four parts includes three steps: (1) mounting the turning member 1 onto the insetting frame 2; (2) mounting the insetting frame 2 (mounted with the turning member 1) onto the mounting base 3; and (3) mounting the pressing piece 4 onto the turning member 1. Each of the four parts 1, 2, 3, 4 is provided with mounting means according to the present invention so as to allow the four parts 1, 2, 3, 4 to be assembled into one switch unit.

(1) Mounting the turning member 1 into the insetting frame 2

As shown in FIG. 2, the tuning member 1 is substantially a rectangular body having its two lengthwise side walls 10*a*, 10*b* each formed with an engaging protrusion 11*a*, 11*b*. Each of the engaging protrusion 11*a*, 11*b* is formed with a sloped convex surface 12*a*; 12*b* and a curved surface 13*a*; 13*b*. The front end of each of the engaging protrusions 11*a*, 11*b* is arrow-shaped headed. Besides, two semi-sphere protrusions 14*a* are formed on the side wall 10*a* (as well as on the side wall 10*b* on the other side, which are not visible in the drawing of FIG. 2). In various modifications, the protrusions 14*a* can also be conically-shaped.

The insetting frame 2 is a rectangular frame having a rectangular opening there-through. On the lengthwise inside walls 20*a*, 20*b* are there each provided with a recessed portion 21*a*, 21*b* Each of the recessed portions 21*a*, 21*b* includes a sloped concave surface and an upright surface 22*b*. The bottom end of each of the recessed portions 21*a*, 21*b* is arrow-shaped so as to accommodate the arrow-head portion of the corresponding engaging protrusions 11*a*, 11*b*, but the angle of the arrow-shaped portion here is slightly greater than that of the arrow-head portion of the engaging protrusions 11*a*, 11*b*. Each of the recessed portions 21*a*, 21*b* is formed in such a way that its shape is substantially in match with the shape of the corresponding engaging protrusion 11*a*, 11*b*, but its width is slightly greater.

To mount the turning member 1 onto the insetting frame 2, the engaging protrusions 11*a*, 11*b* on the turning member 1 are aimed at the corresponding recessed portions 21*a*, 21*b* on the inserting frame 2 and then forcibly pushed by hand into position. Since the turning member 1 and the insetting frame 2 are both made of plastics, their flexible property allows the recessed portions 21*a*, 21*b* to be slightly pushed outwards during the insertion. When in position, the upright surface on each of the recessed portions 21*a*, 21*b* acts as a stopper blocking against the upright surface on each of the engaging protrusions 11*a*, 11*b* such that the turning member 1 is prevented from being pulled away from the insetting frame 2.

Since the width of the recessed portions is slightly greater than that of the engaging protrusion 11*a*, 11*b* and the angle of the arrow-shaped portion of each of the recessed portions 21*a*, 21*b* is slightly greater than that of the arrow-head portion of the engaging protrusions 11*a*, 11*b*, the engagement between the two elements effectively acts as a pivot that allows the turning member 1 to be pressed down on both ends, one end corresponding to the on position of the switch unit and the end to the off position.

With the provisions of the curved surface 13*a*, 13*b* and the semi-sphere protrusions 14*a*, the pivoting movement of the turning member 1 will have minimal surface-to-surface contact between the two parts turning member 1 and insetting frame 2. As a result, the turning member can be pressed to move more smoothly. Besides, the provision of the semi-sphere protrusions 14*a* acts as a buffer that prevents the turning member 1 from coming into contact with the inside wall of the insetting frame 2 such that the turning member 1, would not wobble when it is pressed to turn on/off the switch unit.

(2) Mounting the insetting frame 2 onto the mounting base 3

As shown in FIG. 2, the mounting base 3 is a rectangular member used to house wires and electrical contacts (not shown) for the switch unit. The arrangement of the wires and electrical contacts (not shown) are conventional art so that a description thereof will not be detailed. For the assembly of the insetting frame 2 with the mounting base 3, three hook-shaped pieces 23*a* are formed on each crosswise side of the insetting frame 2 and correspondingly three engaging openings 30*a* are formed on each crosswise side of the mounting base 3.

Figure 3:
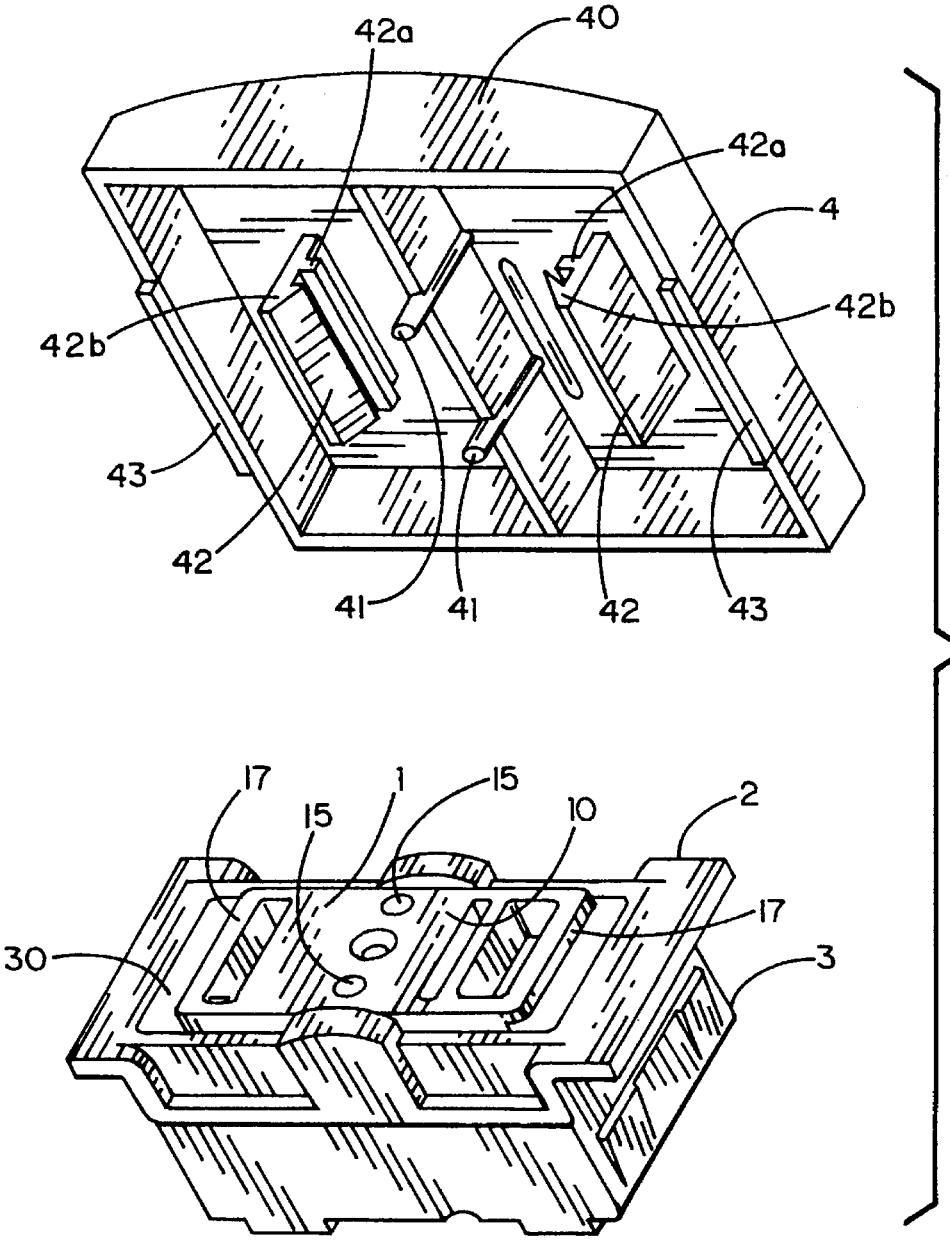
FIG. 3 shows an exploded perspective view of the pressing piece and the turning member which are to be assembled together by means of the mounting structure according to the present invention.

To mount the insetting frame 2 on the mounting base 3, the hook-shaped pieces 23*a* on the insetting frame 2 are aimed at the corresponding engaging openings 30*a* on the mounting base 3 and then forcibly pushed into position. During the insertion, since the head of each of the hook-shaped pieces 23*a* has an angled surface, it can be urged by the inside wall of the mounting base 3 to be slightly bent inwards, allowing it to be pushed forcibly along the inside wall of the mounting base 3. When reaching at the engaging opening 30*a*, the head of the hook-shaped piece 23*a* can be hooked to the engaging opening 30*a*, thereby securing the insetting frame 2 to the mounting base 3. FIG. 3 shows the assembled switch unit and FIG. 4 shows its cross sectional view.

(3) Mounting the pressing piece 4 onto the turning member 1

Referring to FIG. 3, the pressing piece 4 is provided on its back with two pins 41 and two engaging pieces 42 each having a hook portion 42*a* and a stopper portion 42*b*. Corresponding to the two pins 41, two holes 15 are provided on the turning member 1; and corresponding to the two engaging pieces 42, each of the two crosswise edges of the top surface of turning member 1 is extended lengthwise to form a protruded edge 17. The two engaging pieces 42 on the pressing piece 4 are designed in such a way that the gap between the hook portion 42*a* and the stopper portion 42*b* can hold the thickness of the protruded edge 17.

Figure 4:
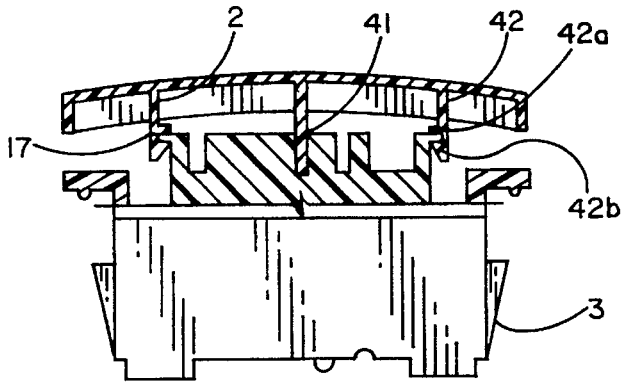
FIG. 4 shows a side view of the assembled switch unit.
Figure 5:
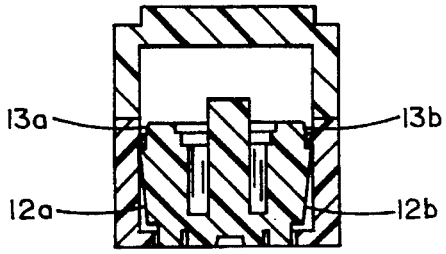
FIG. 5 shows a cross-sectional view of the assembled switch unit.

To mount the pressing piece 4 onto the turning member 1, the two pins 41 on the pressing piece 4 are inserted into the corresponding holes 15 on the turning member 1 and the two engaging pieces 42 on the pressing piece 4 can be pushed slightly forcibly by hand so as to hold the thickness of the protruded edge 17 on the turning member 1 as more clearly shown in FIG. 4. With the pins 41 inserted in the holes 15, the pressing piece 4 can not be moved in any horizontal directions, and with the hook portion 42*a* of each of the engaging pieces 42, the pressing piece 4 can not be moved away from the turning member 1, so that as a result, the turning member 1 is mounted securely on the pressing piece 4.

Modification

Figure 6:
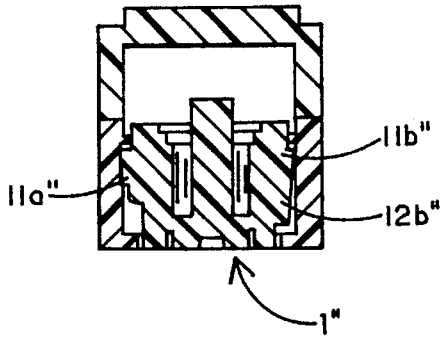
FIG. 6 shows a side view of the switch unit with the mounting structure slightly modified.

FIG. 6 shows a modification to the mounting structure used to assemble the switch unit. The modified mounting structure, here labeled with the same numeral but appended with quotation marks, is different from the one described above (compare particularly to FIG. 3) in that the engaging protrusion 11*a*" is formed with the same structure (as 11*a*), but the engaging protrusion 11*b*" has its engaging surface 12*b*" formed in the shape of a wedge so that the turning member 1 may be more securely mounted onto the insetting frame 2.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A combination of a switch unit and a mounting structure by which said switch unit is assembled, said switch unit comprising a turning member, an insetting frame, a mounting base, and a pressing piece, and said mounting structure comprising:

(a) first mounting means for mounting the turning member onto the insetting frame;

(b) second mounting means for mounting the insetting frame onto the mounting base; and (c) third mounting means for mounting the pressing piece onto the turning member, said first mounting means including two engaging protrusions provided on said turning member and two recessed portions provided on said insetting frame to receive said engaging protrusions to enable said turning member to pivot with resect to said insetting frame, said first mounting means also including a plurality of protrusions extending from said turning member and adapted to contact said insetting frame to prevent said turning member from wobbling with respect to said insetting frame in response to a pressing force applied to said turning member to cause said turning member to move relative to said insetting frame to turn said switch unit on and off;

said second mounting means including a plurality of hook-like members provided on said insetting frame and a corresponding number of engaging holes provided on said mounting base to receive said hook-like members; and said third mounting means including at least two engaging pieces provided on said pressing piece and at least two protruded edges provided on said turning member to be engaged by said engaging pieces.

2. The combination recited in claim 1, wherein each of said two engaging protrusions of said first mounting means provided on said turning member has an arrow-shaped portion and each of said two recessed portions of said first mounting means provided on said insetting frame has an arrow shaped portion, the arrow shaped portions of said two recessed portions being sized to receive therein respective ones of the arrow shaped portions of said two engaging protrusions.

3. The combination recited in claim 2, wherein the angle of the arrow-shaped portion of each of said two recessed portions is greater than the angle of the arrow shaped portion of each of said two engaging protrusions.

4. The combination recited in claim 3, wherein the size and angle of the arrow shaped portions of said two recessed portions relative to the size and angle of the arrow shaped portions of said two engaging portions permits said turning member to move relative to said insetting frame in response to said pressing force applied to said turning member.

5. The combination recited in claim 1, wherein each of said two engaging protrusions of said first mounting means has a sloped portion and a curved portion.

6. The combination recited in claim 1, wherein each of said two engaging protrusions of said first mounting means is wedge shaped.

7. The combination recited in claim 1, wherein each of said plurality of protrusions of said first mounting means is semi-spherically shaped.

8. The combination recited in claim 1, wherein each of said plurality of protrusions of said first mounting means is conically shaped.

9. The combination recited in claim 1, wherein each of said at least two engaging pieces of said third mounting means has a hook portion and a stopper portion, a gap being formed between each of said hook portions and said stopper portions for holding therein respective ones of said at least two protruded edges provided on said turning member.

10. The combination recited in claim 1, said third mounting means also including at least one pin provided on said pressing piece and at least one hole provided on said turning member for receiving said at least one pin therein.

* * * * *